US006641249B2

(12) United States Patent
Miyauchi

(10) Patent No.: US 6,641,249 B2
(45) Date of Patent: Nov. 4, 2003

(54) RECOVERY UNIT AND INK JET RECORDING APPARATUS

(75) Inventor: Yasuo Miyauchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/907,672

(22) Filed: Jul. 19, 2001

(65) Prior Publication Data

US 2002/0044167 A1 Apr. 18, 2002

(30) Foreign Application Priority Data

Jul. 21, 2000 (JP) ..... 2000-220847

(51) Int. Cl.[7] ..... B41J 2/165; F04B 43/08
(52) U.S. Cl. ..... 347/30; 417/477.7; 417/477.8
(58) Field of Search ..... 347/29, 30; 417/476, 417/477.1, 477.7, 477.8, 477.11, 477.3

(56) References Cited

U.S. PATENT DOCUMENTS

| | | | | |
|---|---|---|---|---|
| 4,021,015 A | * | 5/1977 | Maeder et al. | 251/129.11 |
| 4,142,845 A | * | 3/1979 | Lepp et al. | 417/477.1 |
| 6,082,977 A | * | 7/2000 | Nishioka | 417/476 |
| 6,180,435 B1 | | 1/2001 | Ise et al. | 438/113 |

FOREIGN PATENT DOCUMENTS

| | | |
|---|---|---|
| EP | 0 997 291 | 5/2000 |
| EP | 1 000 748 | 5/2000 |
| JP | UM 53-106802 | 8/1978 |
| JP | 2000-12745 | 1/2000 |
| JP | 2000-127445 | 5/2000 |

OTHER PUBLICATIONS

Frank Cost, Pocket Guide to Digital Printing, 1997, Delmar Publishers, pp. 98–100.*

* cited by examiner

*Primary Examiner*—Judy Nguyen
*Assistant Examiner*—Blaise Mouttet
(74) *Attorney, Agent, or Firm*—Fitzpatrick, Cella, Harper & Scinto

(57) ABSTRACT

A recoverying unit for maintenance and recovery of ink ejection performance of an ink ejecting device includes an elastic tube; a guide member for supporting the tube; a roller for pressing the tube; and a roller holding member, wherein the roller holding member is provided with a guide groove which connects a first position in which the roller presses the tube for substantially hermetically closing the tube, a second position in which the roller presses the tube with a greater pressing degree, and a third position in which the tube is opened, the guide groove is effective to guide movement of the roller between the first position and the third position.

8 Claims, 8 Drawing Sheets

RECOVERY UNIT AND INK JET RECORDING APPARATUS

FIELD OF THE INVENTION AND RELATED ART

The present invention relate to a recovery unit for maintaining and recovering the ink ejection performance of a recording means which records images by ejection ink onto recording medium. It also relates to an ink jet recording apparatus which employs such a recovery unit.

An ink jet recording apparatus which records images by ejecting ink onto recording medium such as paper, fabric, plastic sheet, OHP sheet, and the like, in accordance with image data (recording data), has been widely used as an ordinary printer, a recording apparatus for a copying machine, facsimile machine, or the like, an output device for a complex electronic device such as a computer, a word processor, or the like, or an output device for a work station. Thus, there are various demands concerning the material for the recording medium used with an ink jet recording apparatus. In recent year, many researches have been made to meet such demands, and as a result, a recording apparatus capable of recording on fabric, leather, nonwoven fabric, in addition to paper (inclusive of thin paper and treated paper), which is the most commonly used recording medium, and thin plate of resin (OHP sheet or the like), has been developed, and has been put to practical use. Further, even a recording apparatus capable of using metal or the like as recording medium has been put to practical use.

An ink jet recording apparatus is low in operational noise, low in operational cost, easy to reduce in size, and easy to colorize. Therefore, it is widely used in the field of a printer, a copying machine, a facsimile, and the like. The recording means (ink jet recording head) of an ink jet recording apparatus has an ejection orifice (normally, in plurality) for ejecting an ink droplet, which is in the front surface of the recording means. The diameter of an ejection orifice has been in a range of several tens of microns. Recently, however, an ejection orifice has been further reduce in size to meet increased demand for improvement in image quality. In operation, an image (inclusive of letter and codes) is recorded on recording medium by ink droplets ejected from a plurality of ejection orifices in response to ejection signals created by processing, in a recording apparatus, the recording data sent from a host device.

In the above described ink jet recording apparatus which record images by ejecting ink from its recording means onto recording medium, ink is ejected from a plurality of microscopic ink ejection orifices, some of which sometimes become plugged, which results in poor ejection (inclusive of complete ejection failure), producing images of inferior quality. As for a countermeasure to this problem, it is a common practice to use a recovery unit for maintain and/or recovering the ink ejection performance of the recording means. Generally, a recovering unit comprises: a capping means for capping the ejection orifices of a recording head; a suctioning means connected to the capping means; and a wiping means for wiping away the foreign substances, for example, waste ink, on the recording head surface with the ejection orifices. In an operation for maintaining and/recovering the ink ejection performance of the recording head, the pump of the suctioning means is activated to generate negative pressure within the capping means to suction out the foreign substances such as ink with increased viscosity, air bubbles, and the like, from the ejection orifices, so that the ink within the ejection orifices are replaced with a fresh supply of ink.

In other words, an ink jet recording apparatus is provided with a recovering means, which is equipped with a recovery pump for keeping the recording head of the ink recording apparatus in the normal state of ejection, or for restoring the recording head to the normal state of ejection when the ejection orifices sometimes become plugged. In a recovery operation, ink is suctioned out of the ejection orifices by the negative pressure generated by the pump. As one of the recovery pumps, there is a tube type pump which generates negative pressure with the use of the volumetric change of the internal space of an elastic tube. More specifically, a tube type pump comprises a tube connected to the capping means which covers the recording head, and a roller which is kept pressed upon the tube by a force large enough to temporarily flatten the tube. In operation, the roller is rolled on the tube in a manner to temporarily flatten the tube, so that negative pressure is generated within the tube to suction the ink within the recording head, and that the ink which has been suctioned out of the recording head during the preceding temporary flattening of the tube by the roller, is discharged out of the tube.

A tube type pump is advantageous in that it is simple in structure, and therefore, can be reduced in size without incurring high cost. Thus, there have been developed various tube type pumps. Among them, there is a tube type pump which is very simple in a structure for flattening the tube or allowing the tube to recover; when a roller holding means is rotated in one direction, the roller is rolled on the tube in one direction, flattening the tube, and when the roller holding means is rotated in the opposite direction, the roller is moved in a manner to stop pressing the tube, allowing the tube to recover. One example of such a tube type pump is disclosed in Japanese Laid-open U.M. Application 53-106802. A tube type pump structured as disclosed in this application has a problem that as the force which keeps the roller pressed upon the tube is removed, the roller is made to spring, by the resiliency of the elastic tube, making collisional noises as it collides with the roller holding member. As a countermeasure to such a problem, Japanese Laid-open patent Application 200-012745 discloses an invention, according to which a rubber damper is disposed in alignment with where the roller is freed of the force applied thereto to flattened the tube, so that the collisional noises are reduced.

In a tube type pump structured as described above, however, even though the noises which occur as the roller is freed of the above described force, are reduced with the provision of a rubber damper, the noises similar to those caused by the collision between the roller and roller holding.member occur as the roller is sprung by the resiliency of the rubber damper when the roller passes through the damper. In order to prevent this problem, another rubber damper must be placed in alignment with where the roller comes through the first rubber damper, which will causes the similar noises as it let the roller pass. Therefore, third rubber damper must be disposed, and so on. In other words, it is necessary for a plurality of rubber dampers to be consecutively disposed to cover the entire range between where the roller becomes separated from the tube and where the roller begins to press the tube next time. Consequently, not only does component count increase, but also it becomes difficult to assemble a tube type pump, which results in cost increase.

SUMMARY OF THE INVENTION

The primary object of the present invention is to eliminate the collisional noises caused by the rollers, without relying on rubber dampers, in order to provide a quiet recovery unit which is simple in structure, and also an ink jet recording apparatus compatible with such a recovery unit.

According to an aspect of the present invention, there is provided a recoverying unit for maintenance and recovery of ink ejection performance of ink ejecting means, comprising: an elastic tube; a guide member for supporting said tube; a roller for pressing said tube; and a roller holding member, wherein said roller holding member is provided with a guide groove which connects a first position in which said roller presses said tube for substantially hermetically closing said tube, a second position in which said roller presses said tube with a greater pressing degree, and a third position in which said tube is opened, said guide groove is effective to guide movement of said roller between the first position and the third position.

According to another aspect of the present invention, there is provided an ink jet recording apparatus including a recoverying unit for maintenance and recovery of ink ejection performance of ink ejecting means, comprising: the recoverying unit including an elastic tube; a guide member for supporting the tube; a roller for pressing the tube; and a roller holding member, wherein the roller holding member is provided with a guide groove which connects a first position in which said roller presses said tube for substantially hermetically closing said tube, a second position in which said roller presses said tube with a greater pressing degree, and a third position in which said tube is opened, said guide groove is effective to guide movement of said roller between the first position and the third position.

According to the present invention, no noise is produced by abutment of the roller, and therefore, there is provided a recovery unit or an ink jet recording apparatus in which no noise is produced by movement of the roller without usign a rubber damper.

According to a further aspect of the present invention, drive transmitting means for rotating said roller holding member may be provided with a predetermined degree of angular play.

According to this aspect of the present invention, an additional operation such as shifting the recording means when capping it, is not required.

According to a further aspect of the present invention, it may be that said roller holding member includes a roller holder for holding said roller, a rotatable member for swingably holding the roller holder, and a spring for urging said roller holder, wherein said guide groove is formed on said roller holder and connects the first position and the third position such that radius of curvature of the roller is changed.

According to this aspect, the above-described object is more efficiently accomplished.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 10:
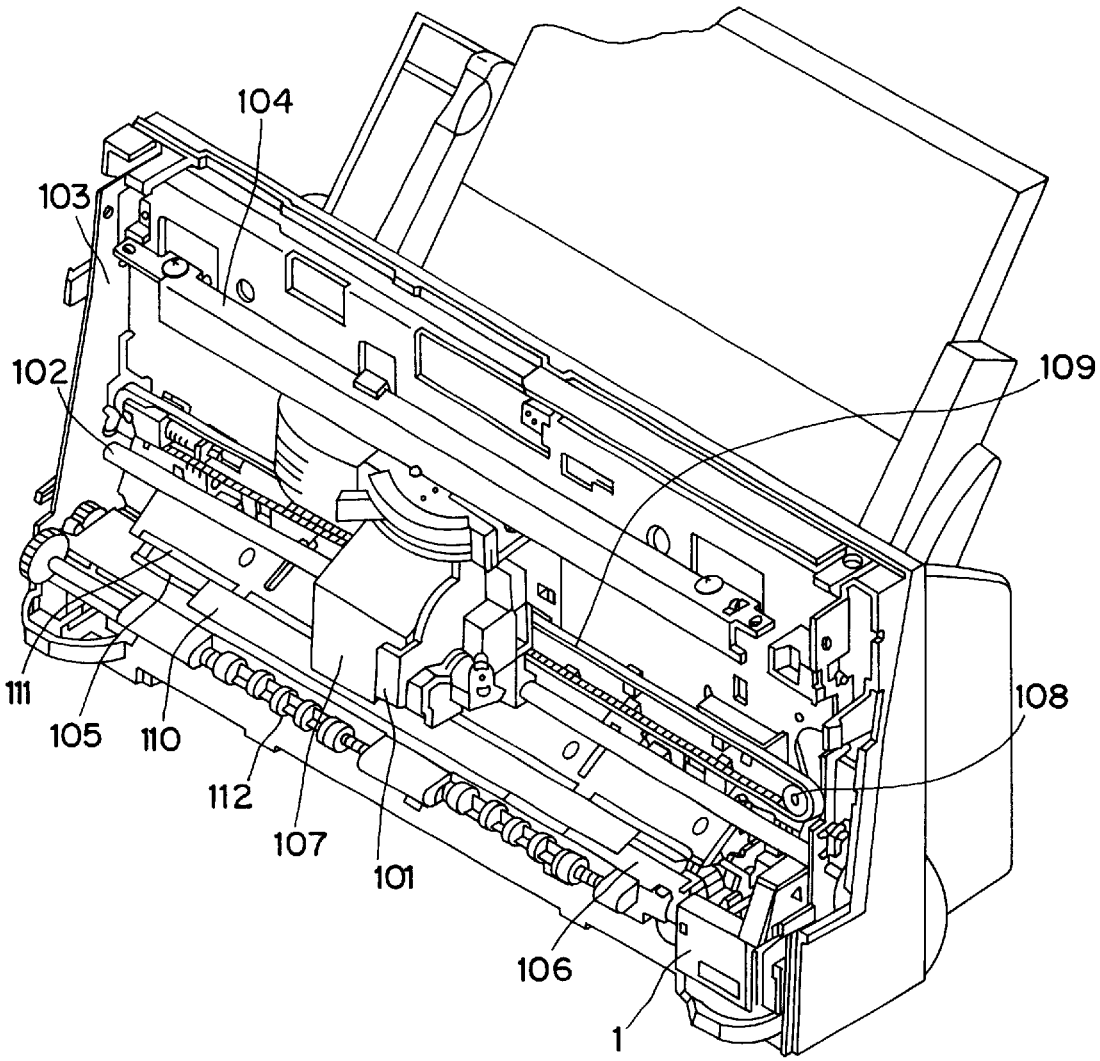
FIG. 10 is a rough perspective view of an embodiment of an ink jet recording apparatus equipped with a preferable recovery unit to which the present invention is applicable.

Hereinafter, the preferred embodiments of the present invention will be concretely described with reference to the appended drawings. FIG. 10 is a rough perspective view of an embodiment of an ink jet recording apparatus equipped with a preferable recovery unit to which the present invention is applicable. In FIG. 10, a carriage 101 is supported and guided in the adjacencies of a conveyer 105 (LF roller) and a platen 106 supported by a chassis 103, by a guide shaft 102 and a guide rail 104, being enabled to bidirectionally move in parallel to the conveying roller 105 (LF roller) and platen 106. A recording head 107 as a recording means is mounted on the carriage 101, and is enabled to bidirectionally be moved along the guide shaft 102 by the driving force transmitted from a carriage motor 108 by way of a belt 109.

A recording paper 110 as recording medium is held in the recording apparatus, being pinched between the conveying roller 105 and a pinch roller 111, and between a discharge roller 112 and an auxiliary discharge roller 113. As the conveying roller 105 rotates, the recording paper 110 is conveyed by friction in the direction perpendicular to the axial line of the conveying roller 105. As recording begins, the carriage 101, which remains stationary while recording is not made, is moved at a predetermined constant velocity after being accelerated to the constant velocity. Then, as the carriage 101 is moved at the predetermined constant velocity, the recording head 107 (recording means) is driven in accordance with the recording data sent into the recording apparatus, causing the recording head 107 to eject ink toward the recording paper 110. Immediately after the carriage 101 is driven long enough for the recording head 107 to make a single pass on the recording paper 110 in a predetermined direction, it is decelerated and stopped.

As the carriage 101 stops, the conveying roller 105 is rotated by an angle equivalent to the single pass of the recording head, conveying the recording paper 110 so that the recording head aligns with the spot on the recording paper 110, at which recording is to begin for the second pass. As the recording medium conveying rotation of the conveying roller 105 ends, the movement of the carriage 101 is restarted, and as the carriage is moved, the recording head 107 is driven to record the portion of an image correspondent to the second pass. This combination of rotating the conveying roller by the predetermined angle and driving the carriage and recording head for a length of time equivalent to the single pass, is repeated until a predetermined amount of recording data is realized into an image. Then, the recording paper 110 is discharged from the recording apparatus by the discharge roller 112, ending the recording operation.

The recording head 107 (recording means) is an ink jet recording means which ejects ink with the use of thermal energy, and is provided with a plurality of electrothermal transducers for generating thermal energy. It records images by ejecting ink from the ejection orifices. More specifically, it ejects ink with the use of the pressure change in the ejection orifices caused by the growth and contraction of the bubbles triggered by the film-boiling (change in the state of ink) caused by the thermal energy applied to the ink by the aforementioned electrothermal transducers.

Figure 11:
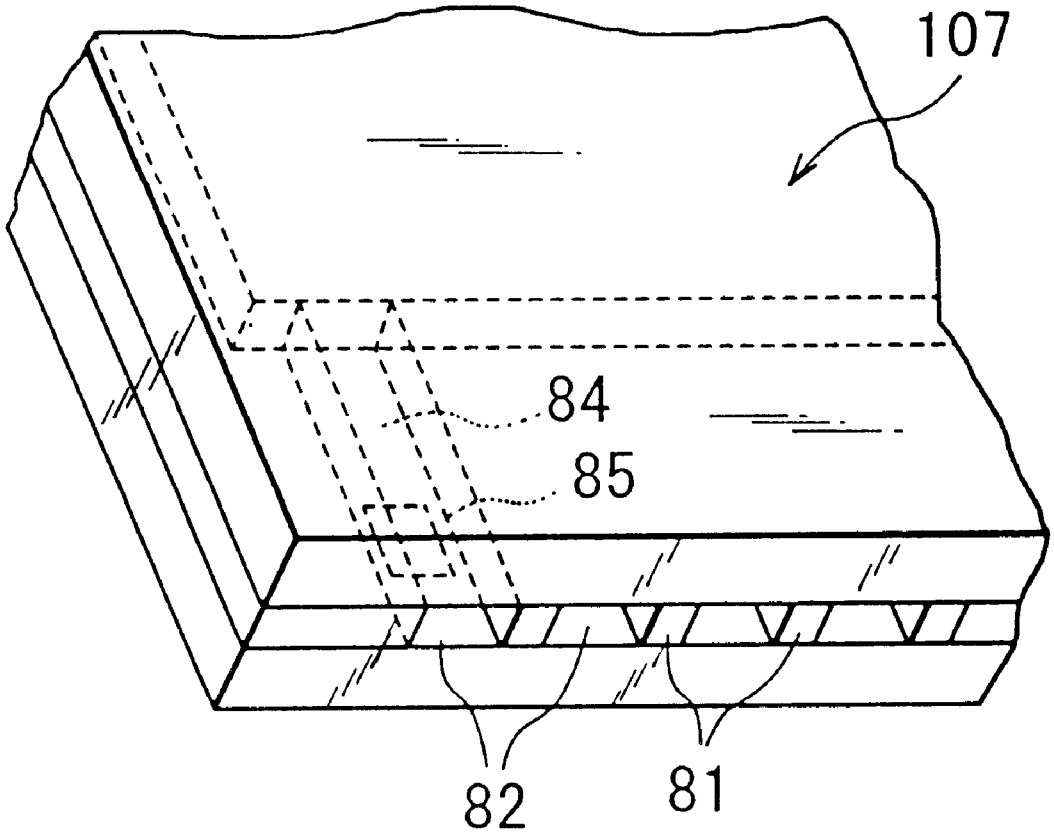
FIG. 11 is a rough perspective view of an essential portion of the ink ejecting section of the recording means in FIG. 10, for depicting the structure thereof.

FIG. 11 is a rough perspective view of the essential portion of the ink ejection portion of the recording head 107 in FIG. 10, for showing the structure thereof. In FIG. 11, the surface 81 of the recording head 107 faces the recording medium 110, for example, recording paper, holding a predetermined gap (for example, approximately 0.3–2.0 mm) from the recording medium 110. This recording head surface 81 has a plurality of ejection orifices 82, which align in a straight column at a predetermined pitch. Each ejection orifice 82 is connected to a common liquid chamber by a liquid path 84, on one of the walls of which an electrothermal transducer 85 (heat generating resistor or the like) for generating ink ejection energy is disposed. In this embodiment, the recording head 107 is mounted on the carriage 101 in such a manner that the aforementioned column of the ejection orifices 82 becomes perpendicular to the direction in which the carriage 101 is moved in a manner to scan the recording medium 110. In an image forming operation, the electrothermal transducers 85 are driven (electricity is flowed through electrothermal transducers) by image signals or ejection signals to heat the ink within the liquid path 84 to a point of film-boiling, and as a result, the ink is ejected from the ejection orifice 82 by the pressure generated by the film-boiling of the ink.

In FIG. 10, the recording apparatus is provided with a recovery unit 1 for maintaining the ink ejection of performance of the recording means by preventing the plugging, or the like, of the recording means (recording head), and/or for restoring the ink ejection performance by unplugging the recording means (recording head). The recovery unit 1 is provided with a cap for covering (capping) the recording head (surface with ejection orifices) in order to protect the recording head 107 and also to reduce the amount of the ink evaporation from the ejection orifices, while recording is not made. Further, when recording is restarted after the recording head is kept capped for a long period of time, a process for restoring the performance of the recording head is carried out to stabilize ink ejection. In this process, ink is suctioned out of the ejection orifices, prior to the restarting of recording, by activating the pump (suction pump) connected to the cap airtightly covering the recording head surface with the ejection orifices, to eliminate such ink that is about to solidify (ink with increased viscosity). As for the pump, or a suctioning means, for restoring the recording head performance by suction/discharge the ink within the recording head, a tube type pump is employed, which generates negative pressure by rolling a single or a plurality of rollers (pressing roller) on the tube connected to the cap, while pressing the roller upon the tube so that the tube is temporarily flattened as the roller is rolled on the tube.

Figure 1:
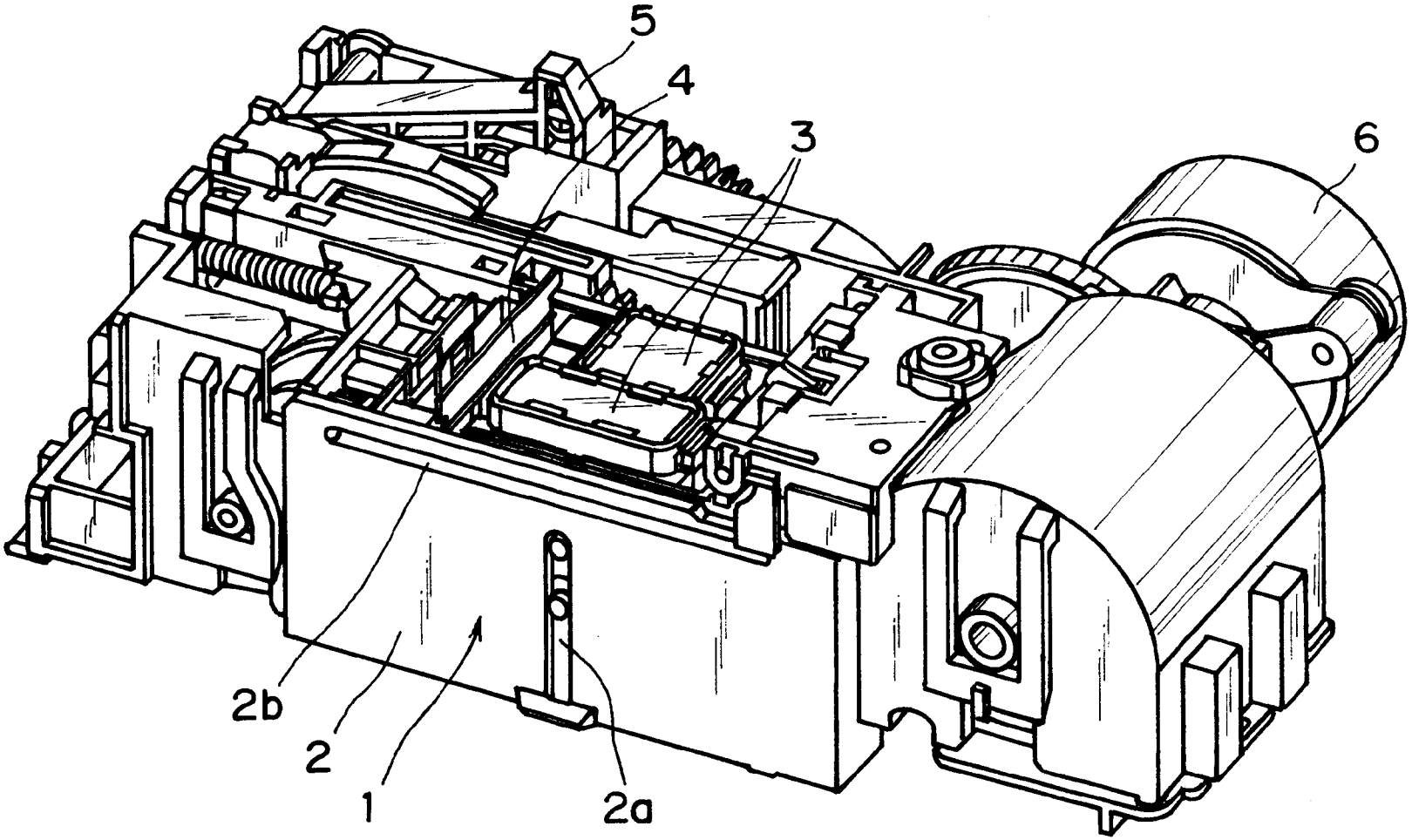
FIG. 1 is a rough perspective view of the first embodiment of a recovery unit for an ink jet recording apparatus, in accordance with the present invention.
Figure 2:
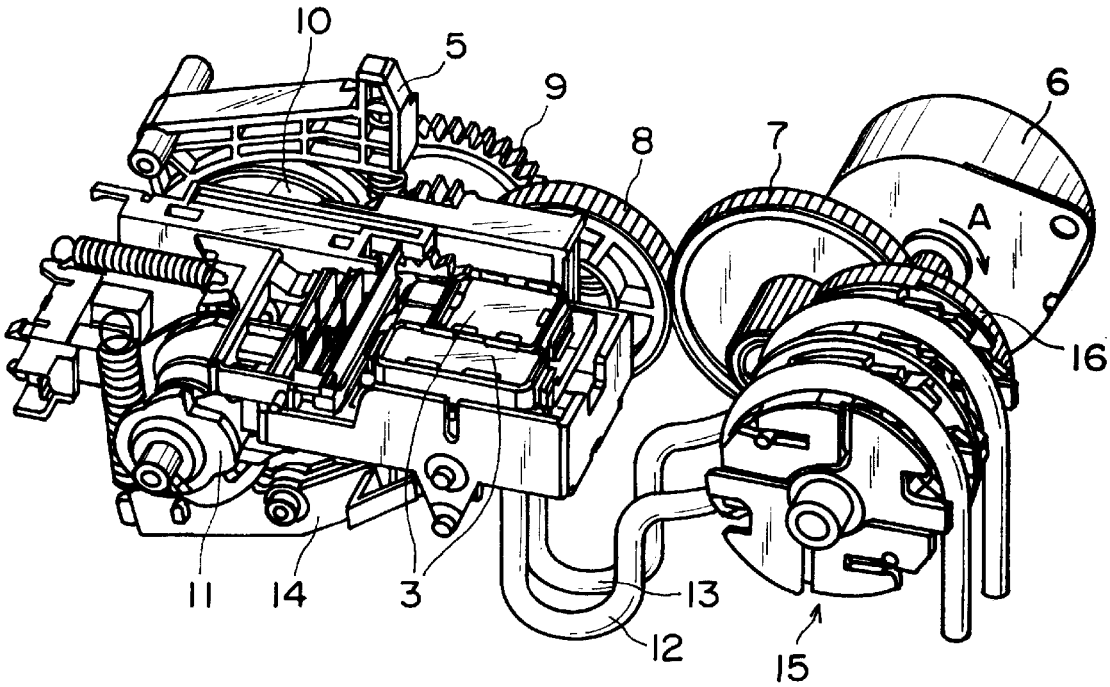
FIG. 2 is a rough perspective view of the internal assembly of the recovery unit in FIG. 1.

FIG. 1 is a rough perspective view of the first embodiment of the recovery unit of the ink jet recording apparatus in accordance with the present invention. FIG. 2 is a rough perspective view of the internal assembly of the recovery unit in FIG. 2. Referring to FIGS. 1 and 2, the recovery unit 1 comprises: a cap 3 which is vertically movable following a guide 2*a* of a base 2 to cover or to be separated from the recording head surface (unshown) with the ejection orifices; a wiper 4 which is reciprocally movable following a guide 2*b* to wipe the recording head surface with the ejection orifices; a carriage locking means 5 for keeping the carriage (unshown) locked in place to prevent the carriage from being accidentally moved while the recording head surface with the ejection orifices is wiped.

The cap 3, wiper 4, and carriage locking means 5 are moved by the rotation of a main cam shaft 11. More specifically, the driving force of a motor 6 is transmitted to the main cam shaft 11 through a gear train comprising gears 7, 8, and 9, and a one-way clutch 10 which allows the driving force to be transmitted to the main cam shaft 11 to rotate it only when the motor 6 rotates in verse. The main cam shaft 11 is provided with a plurality of cams which align in the lengthwise (axial) direction of the cam shaft 11, so that as the main cam shaft 11 is rotated, one of the cams causes the carriage locking means 5 to pivot; the second cam causes, in coordination with a combination of a rack and pinion gear, the wiper 4 to make reciprocal linear movement or the like; and the third cam causes, in coordination of a lever 14, the cap 3 to vertically move.

As is evident from the drawings, the cap 3 is an integral combination of two caps; it has two chambers, which are connected to tubes 12 and 13, one for one. The tubes 12 and 13 constitute parts of the tube type pump as a suctioning means, and are extended following the semicylindrical surface of a part of the base 2. The tubes 12 and 13 are connected to the two chambers of the cap 3, one for one, with the interposition of cap holder (unshown) and the like, by one end; the internal spaces of the tubes 12 and 13 are connected to the internal spaces of the two chambers of the cap 3, one for one. In order to maintain and/or restore the recording head performance, the cap 3 is placed in contact with the recording head surface with the ejection orifices so that the two chambers of the cap 3 airtightly cover the recording head surface with the ejection orifices, and the tube type pump is activated to suction out the ink which contains ink with increased viscosity, bubbles, and the like. As the tube type pump operates, the ink with increased viscosity, bubbles, and the like, are suctioned out of the ejection orifices of the recording head 107 along with the normal ink, and are discharged, as waste ink, out of the tubes 12 and 13, from the ends of the tubes opposite to the ends by which they are attached to the cap 3; in other words, they are discharge out of the recovery unit 1.

Figure 3:
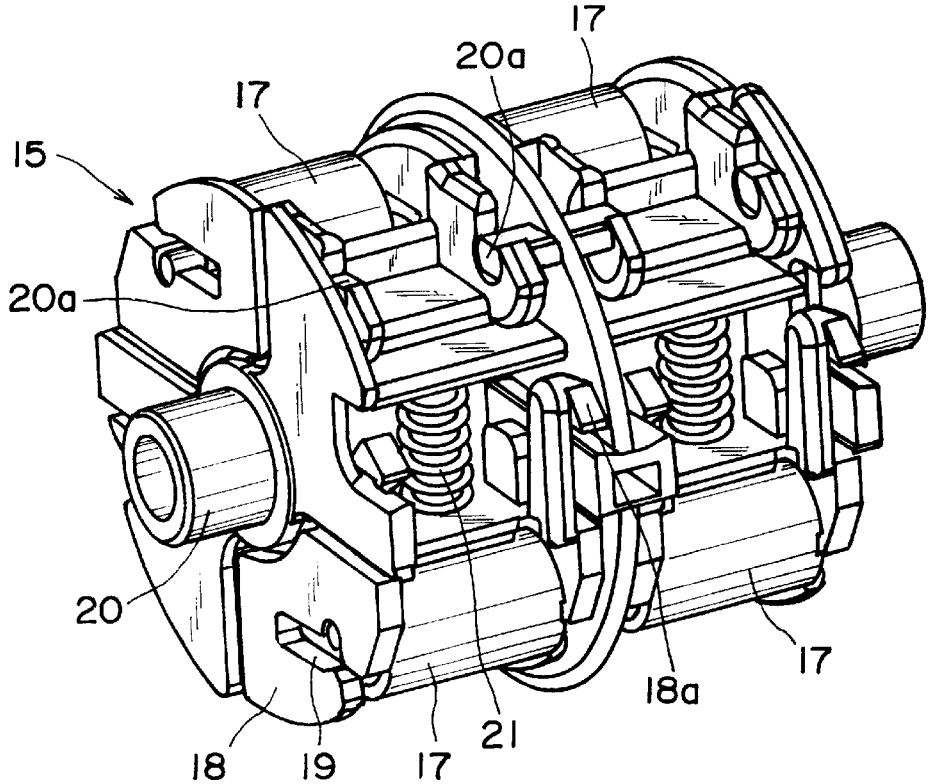
FIG. 3 is a rough perspective view of the roller holding means of a tube type pump as a suctioning means of the recovery unit in FIG. 1, for showing the structure thereof.

FIG. 3 is a rough perspective view of the tube type pump, as a suctioning means, of the recovery unit 1, for showing the structure of the roller holding means 15. Referring to FIGS. 1 and 3, the recovery unit 1 comprises the roller holding means 15 (roller holder), which is rotationally disposed within the base 2, and the axial line of which coincides with the axial line of the semicylindrical guide portion of the base 2. The roller holding means 15 has two pairs of rollers 17 (pressure rollers), or a total of four rollers, which are rotationally supported on a pair of shafts extending in the direction perpendicular to the two tubes disposed in contact with the semicylindrical portion of the base 2. In each pair of rollers, the rollers are symmetrically disposed with respect to the axial line of the roller holding means 15. Further, the two pairs of rollers are aligned in the axial direction of their shafts; the rollers are aligned in a pair in the axial direction of their shafts. In operation, the driving force from the motor 6 is transmitted through the gear 7 to a pump gear 16 fixed to one end of the roller holding means 15, to rotate the roller holding means 15. As the roller holding means 15 rotates, the rollers 17 are made to roll on the tubes 12 and 13 while temporarily flattening the tubes 12 and 13. As a result, negative pressure is generated in the cap side portions of the tubes 12 and 13.

In this embodiment, the recovery unit 1 is structured so that as the roller holding means 15 rotates in a predetermined direction, the rollers 17 flatten the tubes 12 and 13 while rolling on them to generate suctioning force. In other words, as the motor 6 rotates in the direction indicated by an arrow mark A, the tube type pump (roller holding means 15) rotates, but the one-way clutch does not engage, and therefore, the main cam shaft 11 does not rotates, leaving the cap 3, wiper 4, and carriage locking means 5 stationary. On the other hand, as the motor 6 rotates in the direction opposite to the direction of the arrow mark A, the cap 3, wiper 4, and carriage locking means 5 are activated with predetermined timings, and the rollers 17 are freed, and remain free, of the pressure applied thereto to temporarily flatten the tubes 12 and 13; in other words, the tube type pump as a suctioning means remains deactivated.

Next, the gist of the present invention, that is, the structure of the tube type pump, will be described in detail, with reference to one of the virtually identical pumping sections of the tube type pump in this embodiment. Referring to FIG. 3, which shows the structure of the roller holding means 15, a pair of the rollers 17 are fitted in the guide grooves 19 of the roller holders 18, being therefore supported by the roller holders 18, which are attached to the rotational plates 20, one for one, being rendered pivotable about supporting shafts 20*a*. The pivotably supported roller holders 18 are kept pressed in a predetermined direction by a pair of springs 21. In other words, the rollers 17 are pressed upon the tubes 12 and 13 by the resiliency of these springs 21. When the stopper pawls 18*a* of the roller holders 18 are in engagement with specific portions of the rotational plates 20, the rollers 17 are positioned not to flatten the tubes 12 and 13. The tube type pump in this embodiment comprises four sets of a roller 17 and a roller holder 18, and these four sets are mounted on the rotational plates 20 so that each tube 12 (13) can be flattened by a pair of rollers 17.

In other words, the tubes 12 and 13, the internal spaces of which are connected to the two internal spaces of the cap 3, one for one, are extended in a manner to follow the internal surface of the semicylindrical guide portion 2*c* of the pump base 2, and are flattened as they are pinched between the roller 17 and semicylindrical guide portion 2*c*. As the tube type pump (actually, the rotational plate 20) is rotated in the direction of an arrow mark B while the recording head 107 is airtightly capped by the cap 3, the rollers 17 temporarily flatten and squeeze the tubes 12 and 13 while rolling thereon. As a result, negative pressure is generated within the cap 3 side portions of the tubes 12 and 13, and this negative pressure reduces the pressure within the space (sealed space) between the recording head 107 and cap 3. Consequently, the ink within the recording head 107 is suctioned out into the tubes 12 and 13, becoming waste ink.

As the rollers 17 are made to roll further on the tubes 12 and 13 while flattening and squeezing them, the waste ink flows toward the other ends of the tubes 12 and 13 following the rollers 17, and is eventually discharged out of the tubes 12 and 13 by the other rollers 17. As the rotational plates 20 are rotated further while causing the rollers 17 to temporarily flatten and squeeze the tubes 12 and 13, the rollers 17 are moved out of the range of the semicylindrical guide portion 2*c* of the pump base 2, and therefore, stop flattening the tubes 12 and 13. At the same time as a first roller 17, or one of the pair of rollers 17, is moved out of the range of the semicylindrical guide portion 2*c* of the pump base 2, a second roller 17, or the other of the pair of roller 17, begins to flatten the tube 12. Thus, the ink can be continuously suctioned out of the ejection orifices of the recording means 107, and discharged.

Figure 4:
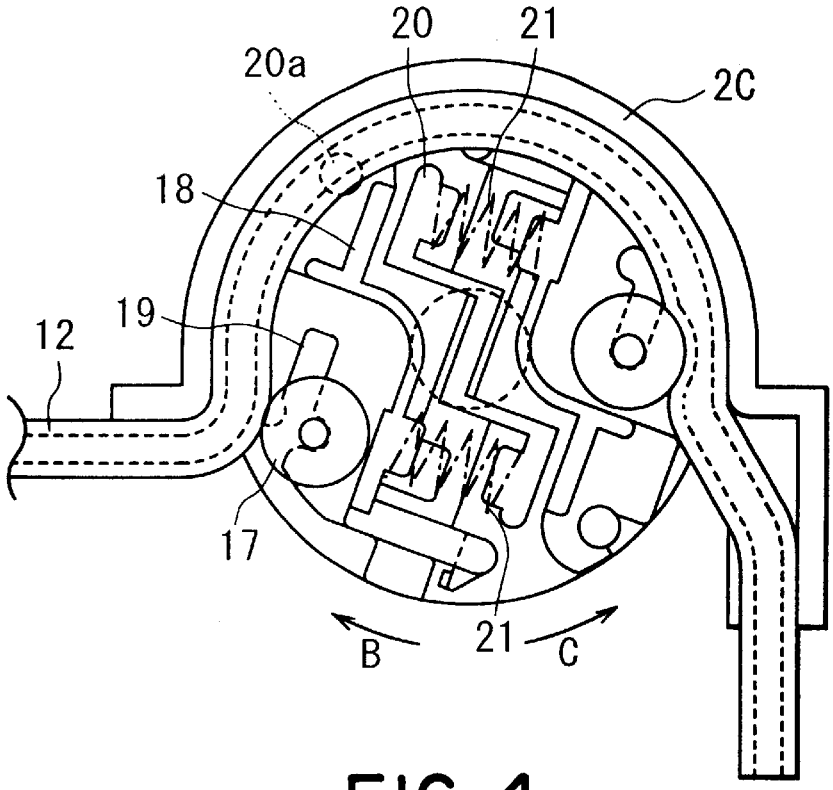
FIG. 4 is a rough cross sectional view of the tube type pump as the suctioning means of the first embodiment of a recovery unit in accordance with the present invention, in which the tube is unflattened state.
Figure 5:
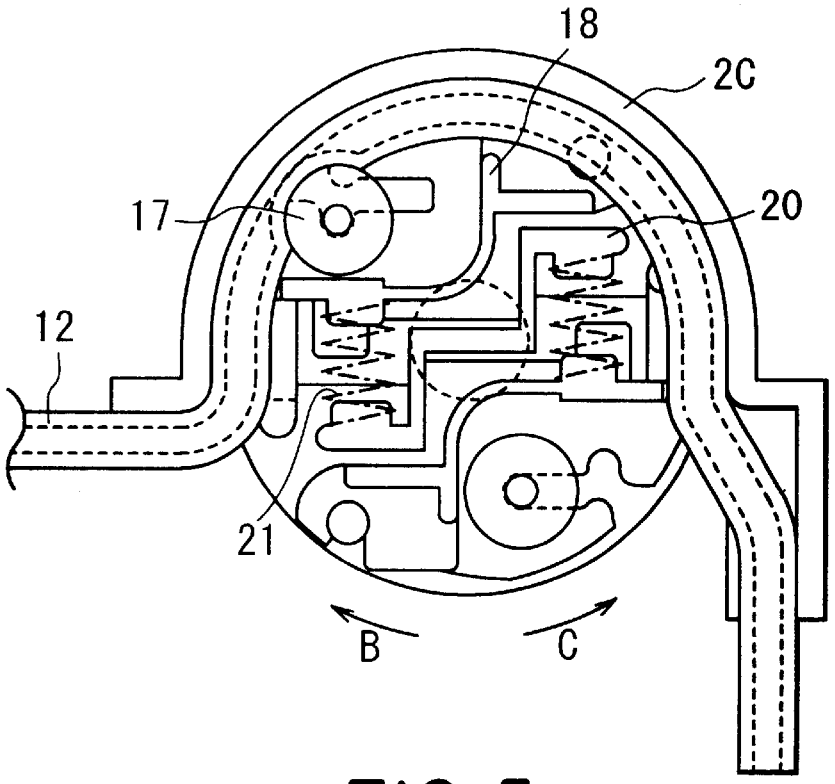
FIG. 5 is a rough cross sectional view of the tube type pump in FIG. 4, in which the roller is moving while temporarily flattening the tube.
Figure 6:
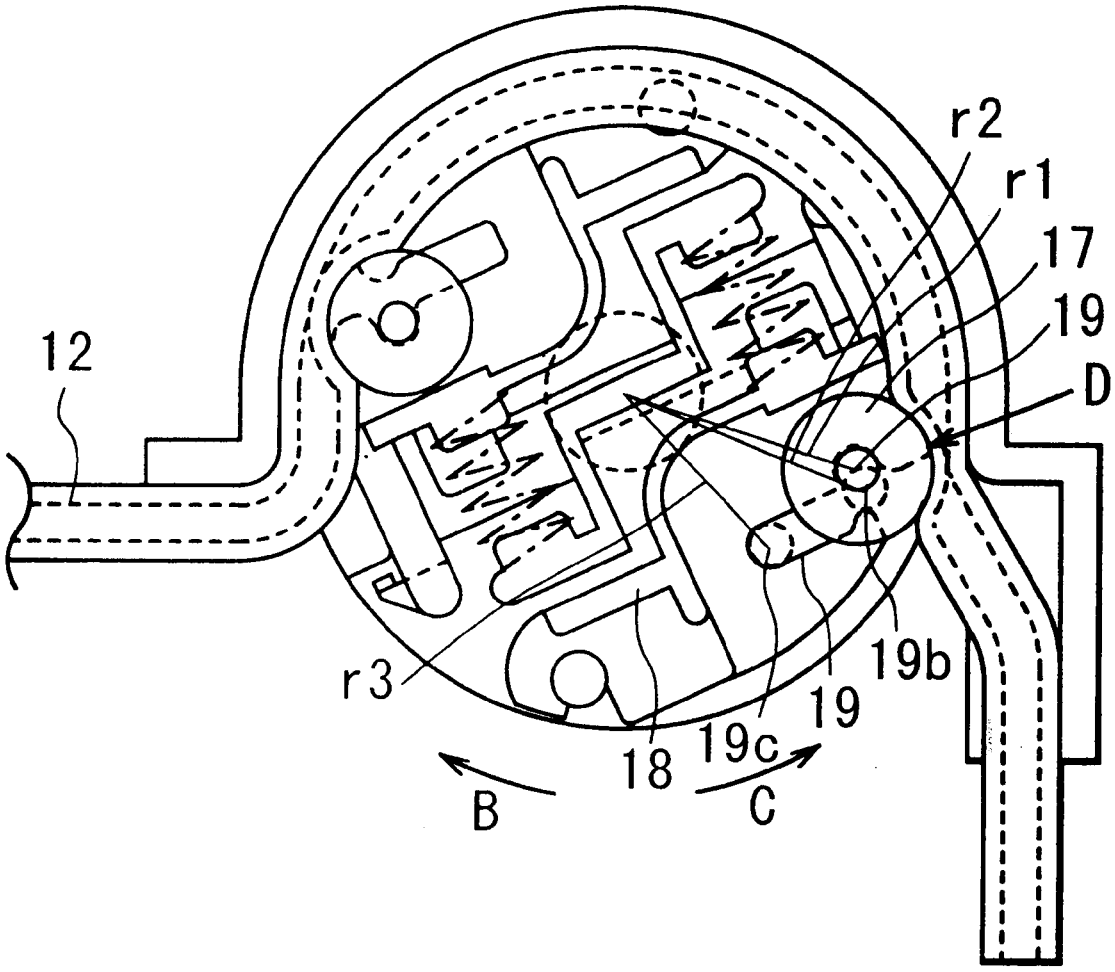
FIG. 6 is a rough cross sectional view of the tube type pump in FIG. 4, in which the roller is at the very end of the process in which the roller moves while temporarily flattening the tube.

FIGS. 4, 5, and 6 are rough sectional views of the tube type pump shown in FIGS. 1 and 2, each progressively showing the consecutive operational states of the pump. Next, referring to these drawings, the operation of the tube type pump in accordance with the present invention will be described. In FIG. 4, the tube 12 is in the unflattened state. As the motor 6 rotates in the direction of the arrow mark A, the rotational plates 20 are rotated in the direction of the arrow mark B. As the rotation plates 20 rotate in the direction of the arrow mark B, the first roller (pressure roller) as a pressing member comes into contact (engages) with the tube 12. Referring to FIG. 5, as the rotation plates 20 further rotate, the first roller is pressed toward the tube 12 by the resiliency of the spring 21. As a result, the tube 12 is completely flattened by the first roller 17 and semicylindrical guide portion 2*c* (airtightly sealing the space in the cap side portion of the tube 12). In this state, the rotational plates 20 are further rotated in the direction of the arrow mark B, causing the first roller 17 to roll on the tube 12 while flattening and squeezing the tube 12. Consequently, negative pressure is generated within the cap side portion of the tube 12, causing the ink within the recording head to be suctioned out of the ejection orifices to be discharged. Then, as the rotational plates 20 are further rotated in the direction of the arrow mark B, the first roller 17 comes to the point shown in FIG. 6, at which the first roller 17 comes out of the range of the semicylindrical guide portion 2*c*, and therefore, stops flattening the tube 12, allowing the resiliency of the tube 12 to restore the tube 12 to the normal shape. At this point, the first roller 17 is still subjected to the reactional force generated, in the direction indicated by an arrow mark D, in the tube 12 as the tube 12 is flattened by the first roller 17.

While the first roller 17 is flattening the tube 12 in coordination with the semicylindrical guide portion 2*c*, the first roller 17 is subjected to the force generated by the resiliency of the tube 12, and this force act in the direction indicated by an arrow mark D in FIG. 6, which is approximately in parallel to the direction in which the guide groove 19 extends (that is, the direction in which the first roller 17 is allowed to move). Thus, if the recovery unit 1 has a simply shaped guide groove 19 such as the one found in a conventional performance recovery unit, as soon as the first roller 17 comes out of the range of the semicylindrical guide portion 2*c*, the first roller 17 is sprung out along the guide groove 19 by the resiliency of the tube 12, generating loud noises as it collides with certain portions of the roller holder 18, and the like. In comparison, in the case of the recovery unit in this embodiment shown in drawings, the guide groove 19 is given such a shape that is capable of cushioning the reactional force from the tube 12. Therefore, it does not occur that the first roller 17 is sprung out. Thus, the aforementioned collisional noises or the like do not occur, and even if they occur, they will be much smaller than those that occur in a conventional pump.

Next, the shape of the guide groove 19 in this embodiment will be concretely described. Referring to FIG. 6, the guide groove 19 is provided with a first recess 19*a* (axial line of which holds a distance of r1 from the rotational axis of the rotational plate 20), in which the first roller 17 remains to flatten and squeeze the tube 21 to generate negative pressure within the cap side portion of the rube 12, a third recess 19*c* (axial line of which holds a distance of 43 from the rotational axis of the rotational plate 20), in which the first roller 17 remains to remain separated from the tube 12, and therefore, not to flatten and squeezes the tube 12, and a recess 19*b* (axial line of which holds a distance of r2 from the rotational axis of the rotational plate 20), in which the first roller 17 remains to apply pressure to the tube 12 by an amount greater than the amount necessary to flatten and squeeze the tube 12. Further, the guide groove 19 is angled so that an inequality: r3<r1<r2 is satisfied. With the provision of this structural arrangement, the reactional force (resiliency) of the tube 12 is temporarily borne by the guiding surface, which connects the first recess 19*a*, in which the first roller 17 remains to flatten and squeeze the tube 12 to airtightly seal the cap side portion of the tube 12, and the second recess 19*b* in which the first roller 17 remains to apply pressure to the tube 12 by an amount g2reater than the amount necessary to flatten and squeeze the tube 112 to generate the negative pressure. Therefore, the first roller 17 is allowed to remain in the recess 19*a* while the force applied to the tube 12 by the first roller 17, that is, the force which generates reactional force in the tube 12, gradually reduces. Consequently, it does not occur that the first roller 17 suddenly moves, and therefore, the collisional noises associated with the sudden movement of the first roller 17 does not occur. In other words, the present invention can prevent the occurrence of irritating collisional noises.

Next, what occurs as the motor 6 is rotated in reverse will be described. As the motor 6 rotates in reverse, the rotational plates 20 are rotates in reverse, or the direction indicated by an arrow mark C. In the case of the recovery unit 1 in the first embodiment of the present invention, which was described with reference to FIGS. 3 and FIG. 6, when the first roller 17 is stationary at the position shown in FIG. 5, that is, a point in the range in which the roller 7 flattens the tube 12 (flattening and squeezing position), even if the rotational plates 20 are rotated in reverse, that is, in the direction of the arrow mark C, the first roller 17 is not allowed to come out of the second recess 19*b*, in which the roller 17 has been remaining while flattening the tube 12. In other words, it does not-occur that the first roller 17 is allowed to be sprung away from the tube 12 by the resiliency of the tube 12 as it is in a conventionally structured recovery unit. As is evident from this description, in this first embodiment, the above described technical problem is solved by changing the positioning of the third recess 19*c*. More specifically, in the first embodiment, as the first roller 17 is moved out of the range of the semicylindrical guide portion 2*c*, the tube 12 is naturally relieved of the force from the roller 17. If the continuous reversal rotation of the rotation plates 12 causes the second roller 17, or the roller 17 on the bottom side in FIG. 5, to enter the range of the semicylindrical guide portion 2*c*, the second roller 17 remains in the third recess 19*c* due to the self-weight and the resiliency of the tube 12, allowing the tube 12 to remain intact, or unflattened, as does the first roller 17, or the right-hand roller 17 in FIG. 4. In FIG. 4, the right-hand roller 17 is in contact with the tube 12, slightly constricting the tube 12. However, the guide groove 19 may be structured so that the roller 17 remains separated from the tube 12 when it is in the recess 19*c*.

In an actual operation for recovering the ink ejection performance of the recording head carried out by the recovery unit 1, first, the recording head is moved to a location at which the recording head aligns with the cap 3. Then, the recording head surface with the ejection orifices is capped by the cap 3 by moving the cap 3 upward by rotating the main cam shaft 11 by the reverse rotation of the motor 6. Next, the motor 6 is rotated in the forward direction, or the direction of the arrow mark A, for a predetermined length of time, causing the roller 17 to pump to generate negative pressure so that ink is suctioned out of the ejection orifices of the recording head to be discharged. Thereafter, the recording head is slightly moved, while remaining capped with the cap 3, to allow the air to leaks into the cap 3. Then, the rollers 17 are made to take the pumping action to draw out only the ink remaining in the cap 3. Then, the motor 6 is rotated in reverse to lower the cap 3. During this second reverse rotation of the motor 6, it does not occur, as described before, that the rollers 17 are immediately allowed to come out of the recess 19*b*, in which the rollers 17 have remained to presses the tube 12. Therefore, before the cap 3 begins to descend, positive pressure is generated in the cap side portion of the tube 12. However, the airtight contact between the cap 3 and recording head has been already broken, and therefore, it does not occur that the recording head is damaged by this positive pressure.

Next, the wiper is activated by the further reversal rotation of the motor 6. During this reversal rotation of the motor 6, the roller 17 is moved out of the range of the semicylindrical guide portion 2*c*, and as it is moved out of this range, it moves into, and remains in, the position in which it does not flatten the tube 12, as described before, until the next suctioning of the ejection orifices. As is evident from the description given above, the present invention makes it possible to reduce the noises which the rollers cause during their movements, without requiring the addition of sound damping members such as a rubber damper. In other words, the present invention makes it possible to provide a quiet tube type pump, which is simple in structure.

Figure 7:
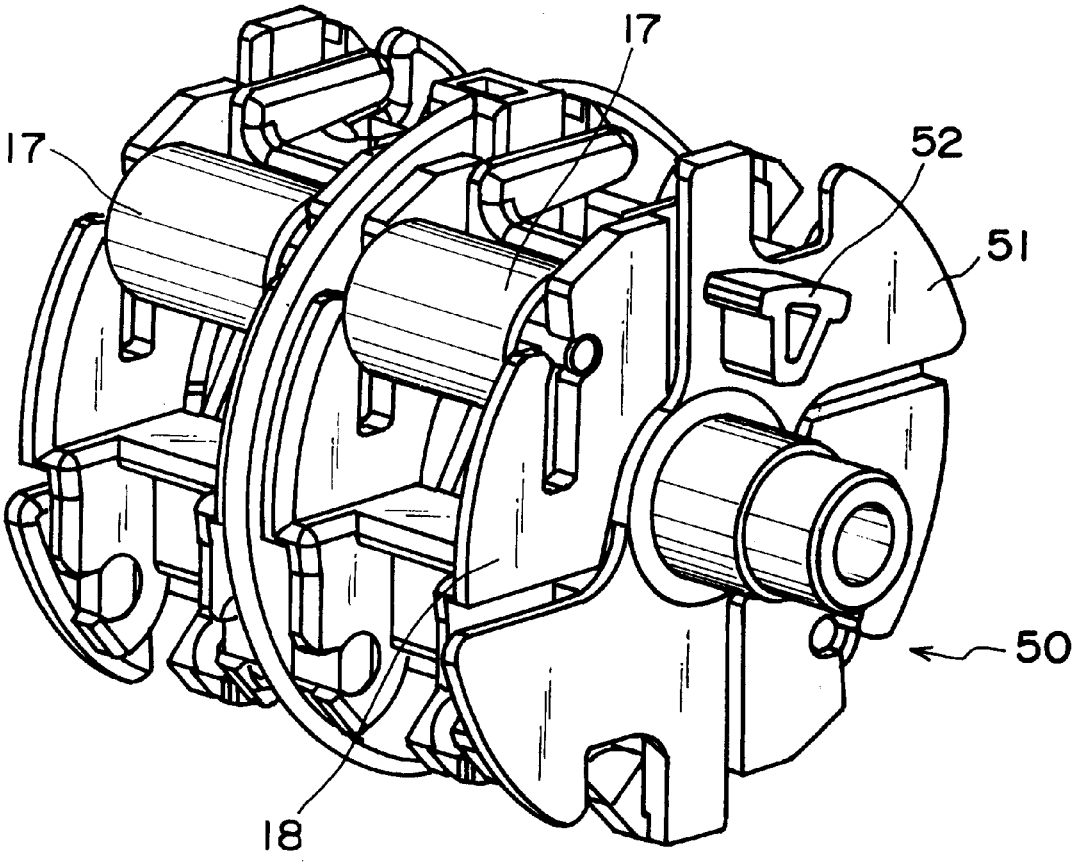
FIG. 7 is a rough perspective view of the roller holding means of the tube type pump, as a suctioning means, in the second embodiment of a recovery unit in accordance with the present invention.
Figure 8:
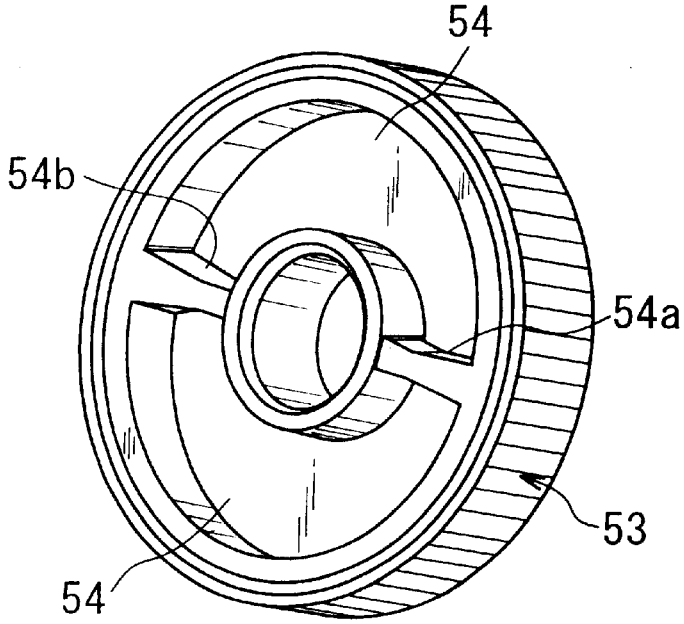
FIG. 8 is a rough perspective view of a pump gear for driving the tube type pump, as a suctioning means, in the second embodiment of a recovery unit in accordance with the present invention.

Next, the second embodiment of the present invention will be described. FIG. 7 is a rough perspective view of the roller holding means of the pump, as a suctioning means, in the second embodiment of the recovery unit in accordance with the present invention. FIG. 8 is a rough perspective view of the pump gear for driving the pump, as a suctioning means, in the second embodiment of the recovery unit in accordance with the present invention. In the two drawings, the descriptions of the components or portions similar to those in the first embodiment will be omitted, and mainly, the components and portions different from those in the first embodiment will be described. Referring to FIG. 7, the rotational plate 71 of the roller holding means in this embodiment is provided with a projection 52. Referring to FIG. 8, a pump gear 53 for driving the tube type pump as a suctioning means, on the other hand, is provided with a recess 54. After the roller holding means 50 and pump gear 53 are assembled into the recovery unit 1, the driving force transmitted to the pump gear 53 is transmitted to the rotational plate 51 only while the projection 52 is in contact with the wall 54*a* or 54*b* of the recess 54. In other words, the suctioning means (pump) in the second embodiment is provided with a play of a predetermined angle in terms of the rotational direction of the rotational plate 51. Therefore, when the rotational direction of the motor 6 is switched, the rotational plate 51 does not immediately respond to the switch, remaining stationary for a duration equivalent to the play of the predetermined angle. The rotational plate 51 is provided with two recesses 54, and when assembling the tube type pump, the projection 52 may be engaged in either of the recesses 54.

In the first embodiment, the rotational plate 20 and pump gear 16 are rigidly fixed to each other. Therefore, before lowering the cap 3, it is necessary to slightly displace the recording head from the position in which the pumping is done. In this embodiment, however, the rotational plate 51 can be kept stationary for a short time before lowering the cap 3. Therefore, it is unnecessary to slightly displace, or to carry out the like operation, before lowering the cap 3. More specifically, as the motor 6 is rotated in reverse to lower the cap 3 after ink is suctioned out of the recording head by operating the pump while keeping the recording head capped with the cap 3, the rotational plate 51 remains stationary until the cap 3 becomes separated from the recording head 3. Therefore, the recording head is not subjected to positive pressure. As is evident from the description given above, according to this embodiment of the present invention, not only is it possible to provide a tube type pump which is quiet in operational sound and does not require a sound damping member such as a rubber damper, but also it becomes unnecessary to slightly displace the recording head before lowering the cap 3. In other words, one of the steps in a recovery operation can be eliminated. Therefore, the operation of the recovery unit 1 is rendered more reliable.

Figure 9:
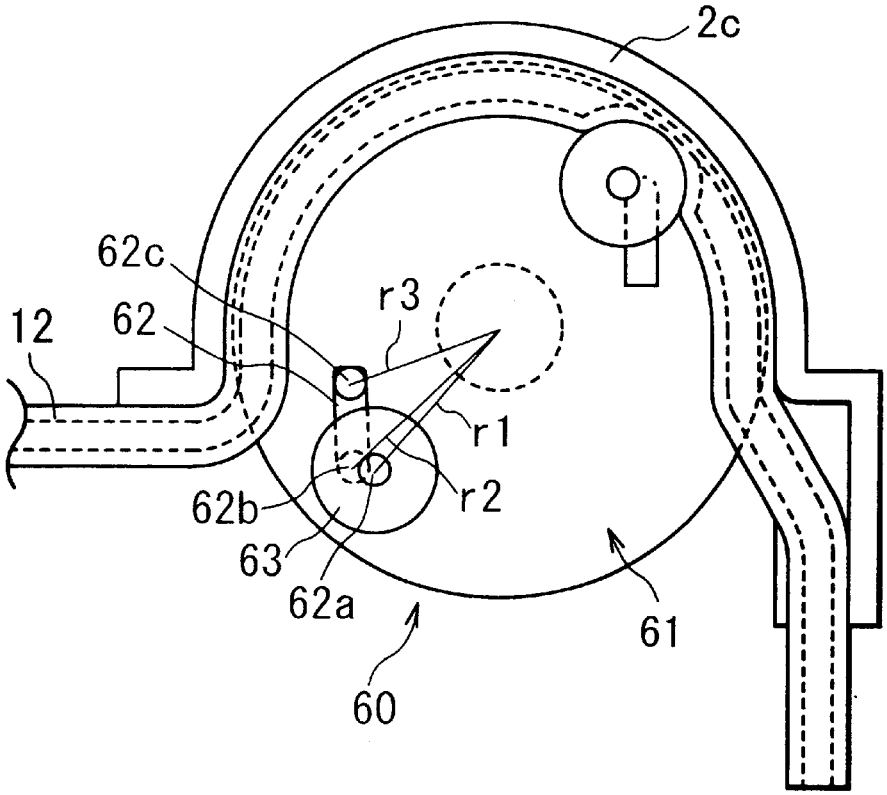
FIG. 9 is a rough sectional view of the tube type pump, as a suctioning means, in the third embodiment of a recovery unit in accordance with the present invention.

Next, the third embodiment of the present invention will be described. FIG. 9 is a rough sectional view of the tube type pump, as a suctioning means, in the third embodiment of the recovery unit in accordance with the present invention. The difference of this embodiment from the first and second embodiments is in the structure of the roller holding means 60. That is, the roller holding means 15 or 50 in the preceding embodiments comprises the rotational plates 20, roller holders 18, rollers 17, and springs 21, whereas the roller holding means 60 in this embodiment comprises only a plurality of rotational plate 61 and a plurality of rollers 63 (pressure rollers), being simpler in structure. The rotational plate 61 is provided with a pair of guiding grooves 62 in which the rollers 63 as tube pressing members are fitted to be supported by the rotational plate 61. The guide groove 62 is provided with a first recess 62*a* (axial line of which holds a distance of r1 from the rotational axis of the rotational plate 61), in which the roller 17 remains to flatten and squeeze the tube 12 to generate negative pressure within the cap side portion of the tube 12, a third recess 62*c* (axial line of which holds a distance of r3 from the rotational axis of the rotational plate 61), in which the roller 17 remains to remain separated from the tube 12, and therefore, not to flatten and squeezes the tube 12, and a recess 62*b* (axial line of which holds a distance of r2 from the rotational axis of the rotational plate 61), in which the roller 17 remains to apply pressure to the tube 12 by an amount greater than the amount necessary to flatten and squeeze the tube 12. The recess 62*b* is between the first and third recesses 62*a* and 62*c*. Further, the guide groove 62 is angled so that an inequality: $r3<r1<r2$ is satisfied. Thus, the tube type pump in this embodiment is much simpler in structure than those in the first and second embodiments, and can yet realize the same operation effects as those realized in the first and second embodiments, being advantageous from the standpoint of cost and affording further size reduction. However, in this embodiment, the amount of the force applied to the roller 17 to flatten the tube 12 when the roller 17 remains in the first recess 62*a* is determined solely by the relationship between the distance between the internal surface of the semicylindrical guide portion 2*c* and the rotational axis of the rotational plate 61, and the distance r1 between the rotational axis of the roller 17 and the rotational axis of the rotational plate 61. Therefore, the shape and measurements of the semicylindrical guide portion 2*c*, the shape and measurements of the guide groove 62 of the rotational plate 61, the diameter of the roller 17, the diameter of the tube 12, and the like, in this embodiment, must be much more strictly regulated than the preceding embodiments. Incidentally, the preceding embodiments were described with reference to a pump structure in which one tube is combined with two rollers. However, the present invention is also applicable to a pump structure in which a single roller, or three or more rollers are combined with a single tube, to realize the same effects as those realized in the preceding embodiments.

Further, the preceding embodiments were described with reference to a serial recording method in which the recording head 7 (recording means) is moved in primary scanning direction. However, the present invention is also applicable to a line recording method, in which a line recording means, which is long enough to cover the recording medium across its entire width or a predetermined range, is used to print an image through the secondary scanning alone, to realize the same effects as those realized in the preceding embodiments. Further, not only is the present invention applicable to an ink jet recording apparatus employing only a single recording head, but also to a color ink jet recording apparatus which records images with the use of a plurality of color inks different in color, a gradation type ink jet recording apparatus which records images with the use of a plurality of inks which are same in color, but are different in density, as well as an ink jet recording apparatus capable of operating in a plurality of modes inclusive of the operation modes of the preceding ink jet recording apparatuses, to realize the same effects as those in the preceding embodiments. In other words, the present invention is applicable an ink jet recording apparatus, regardless of recording head count and recording method.

Further, the present invention is applicable to an ink jet recording apparatus, regardless of the configuration of recording means and an ink storing portion, to realize the same effects as those realized in the preceding embodiments; for example, it is applicable to an ink jet recording apparatus, the recording means of which is in the form of a replaceable ink jet cartridge (head cartridge) in which an ink ejecting portion and an ink storing portion are integrally disposed, an ink jet recording apparatus, the recording means of which is permanent, that is, nonreplaceable, and the like ink jet recording apparatuses. Although the present invention is applicable to any ink jet recording apparatus, for example, an ink jet recording apparatus which employs a recording means (recording head) which uses electromechanical transducers such as piezoelectric elements, it bring forth best results when it is applied to an ink jet recording apparatus which employs a recording means which uses an ink ejecting method which uses thermal energy to eject ink, because such an ink ejecting method makes it possible to increase recording resolution to output highly precise images.

While the invention has been described with reference to the structures disclosed herein, it is not confined to the details set forth, and this application is intended to cover such modifications or changes as may come within the purposes of the improvements or the scope of the following Claims.

What is claimed is:

1. A recovery unit for maintenance and recovery of ink ejection performance of ink ejecting means, comprising:

an elastic tube;

a guide member for supporting said tube;

a roller for pressing said tube;

a roller holder for holding said roller;

a rotatable member for swingably holding the roller holder;

a spring for urging said roller holder; and a guide groove, provided in said roller holder, for guiding movement of said roller, said guide groove connecting a first position in which said roller presses said tube to substantially hermetically close said tube and a third position in which said tube is opened, and there is provided a second position in which said roller presses said tube with a greater pressing degree between said first position and said third position.

2. A recovery unit according to claim 1, wherein said guide groove is bent adjacent the second position.

3. A recovery unit according to claim 1, wherein there is provided a predetermined degree of angular play in a driving force transmitting path, for driving said roller holder, from a motor to said roller holder.

4. An ink jet recording apparatus including a recovery unit for maintenance and recovery of ink ejection performance of ink ejecting means, comprising:

said recovery unit including an elastic tube;

a guide member for supporting said tube;

a roller for pressing said tube;

a roller holder for holding said roller;

a rotatable member for swingably holding the roller holder;

a spring for urging said roller holder; and a guide groove, provided in said roller holder, for guiding movement of said roller, said guide groove connecting a first position in which said roller presses said tube to substantially hermetically close said tube and a third position in which said tube is opened, and there is provided a second position in which said roller presses said tube with a greater pressing degree between said first position and said third position.

5. An apparatus according to claim 4, wherein said guide groove is bent adjacent the second position.

6. An apparatus according to claim 4, wherein said ink ejecting means is provided with an electrothermal transducer for generating thermal energy to be used for ejecting ink.

7. An apparatus according to claim 6, wherein said ink ejecting means ejects the ink using film boiling generated in the ink by the thermal energy generated by said electrothermal transducer.

8. An ink jet recording apparatus according to claim 4, wherein there is provided a predetermined degree of angular play in a driving force transmitting path, for driving said roller holder, from a motor to said roller holder.

* * * * *

UNITED STATES PATENT AND TRADEMARK OFFICE

CERTIFICATE OF CORRECTION

PATENT NO. : 6,641,249 B2
DATED : November 4, 2003
INVENTOR(S) : Miyauchi

It is certified that error appears in the above-identified patent and that said Letters Patent is hereby corrected as shown below:

Title page,
Item [57], ABSTRACT,
Line 1, “recoverying” should read -- recovery --.

Column 1,
Line 7, “relate” should read -- relates --;
Line 9, “ejection” should read -- ejecting --;
Line 22, “year,” should read -- years, --;
Line 40, “reduce” should read -- reduced --;
Line 49, “record” should read -- records --;
Line 52, “become” should read -- becomes --; and
Line 55, “maintain” should read -- maintaining --.

Column 2,
Line 42, “cation 200-012745” should read -- cation 2000-12745 --;
Line 44, “flattened” should read -- flatten --;
Line 51, “ing.member” should read -- ing member --;
Line 55, “causes” should read -- cause --; and
Line 56, “let” should read -- lets --.

Column 3,
Lines 5, 18 and 20, “recoverying” should read -- recovery --.

Column 4,
Line 42 “in” should be deleted.

Column 6,
Line 28, “verse.” should read -- reverse. --.

Column 7,
Line 25, “rotates,” should read -- rotate, --.

Column 8,
Line 15, “roller” (second occurrence) should read -- rollers --;
Line 55, “act” should read -- acts --; and
Line 57, “in” (first occurrence) should be deleted

UNITED STATES PATENT AND TRADEMARK OFFICE

CERTIFICATE OF CORRECTION

PATENT NO. : 6,641,249 B2
DATED : November 4, 2003
INVENTOR(S) : Miyauchi

It is certified that error appears in the above-identified patent and that said Letters Patent is hereby corrected as shown below:

Column 9,
Line 11, “tube 21” should read -- tube 12 --;
Line 12, “rube” should read -- tube --;
Line 13, “of 43” should read -- of r3 --;
Line 30, “g2reater” should read -- greater --;
Line 31, “tube 112” should read -- tube 12 --;
Line 43, “are rotates” should read -- rotate --;
Line 46, “FIG. 6,” should read -- 6, --; and
Line 54, “not-occur” should read -- not occur --.

Column 10,
Line 19, “leaks” should read -- leak --; and
Line 26, “presses” should read -- press --.

Column 11,
Line 44, “plate” should read -- plates --.

Column 12,
Line 59, “bring” should read -- brings --.

Column 13,
Line 4, “Claims.” should read -- claims. --.

Signed and Sealed this

Tenth Day of August, 2004

JON W. DUDAS
*Acting Director of the United States Patent and Trademark Office*